US006880717B1

(12) United States Patent
O'Conor

(10) Patent No.: US 6,880,717 B1
(45) Date of Patent: Apr. 19, 2005

(54) WASTE CONTAINER INCLUDING A DEVICE FOR SECURING A LID THERETO

(76) Inventor: Thomas F. O'Conor, 3117A Bellflower Dr., Vail, CO (US) 81657

( * ) Notice: Subject to any disclaimer, the term of this patent is extended or adjusted under 35 U.S.C. 154(b) by 10 days.

(21) Appl. No.: 10/135,786

(22) Filed: Apr. 30, 2002

(51) Int. Cl.[7] ..... B65D 45/02

(52) U.S. Cl. ..... 220/318; 220/315; 220/908; 220/324; 292/253; 292/288

(58) Field of Search ..... 220/324, 375, 220/810, 315, 318, 835, 908; 224/401, 443, 463, 579, 583, 637, 651, 659, 660; 292/10, 19, 20, 253, 288, DIG. 16; 24/164, 614, 615

(56) References Cited

U.S. PATENT DOCUMENTS

| | | | | | |
|---|---|---|---|---|---|
| 1,732,098 | A | * | 10/1929 | Lessenhop | 383/80 |
| 2,111,359 | A | | 3/1938 | Curtis | |
| 3,147,030 | A | * | 9/1964 | Berk | 292/288 |
| 3,158,393 | A | * | 11/1964 | King | 292/288 |
| 3,291,515 | A | * | 12/1966 | Lierman | 292/288 |
| 3,363,924 | A | | 1/1968 | Remig | |
| 3,893,725 | A | | 7/1975 | Coulter et al. | |
| 3,980,202 | A | | 9/1976 | Monyak et al. | |
| 4,279,357 | A | | 7/1981 | Robinson | |
| 4,413,851 | A | * | 11/1983 | Ritter | 292/259 R |
| 4,515,300 | A | * | 5/1985 | Cohen | 224/153 |
| 4,545,501 | A | | 10/1985 | DeFord | |
| 4,593,841 | A | * | 6/1986 | Lange | 224/153 |
| 4,976,371 | A | * | 12/1990 | Wise et al. | 220/315 |
| 5,078,295 | A | | 1/1992 | Grant | |
| 5,297,692 | A | | 3/1994 | Kronmiller | |
| 5,385,258 | A | | 1/1995 | Sutherlin | |
| 5,568,951 | A | * | 10/1996 | Morgan | 292/307 A |
| 5,620,215 | A | * | 4/1997 | Janeway | 292/256 |
| 5,738,395 | A | | 4/1998 | Probst | |
| 5,758,914 | A | * | 6/1998 | Ioveno | 292/288 |
| 5,791,026 | A | * | 8/1998 | Anscher | 24/615 |
| 6,041,960 | A | * | 3/2000 | Leal | 220/315 |
| D433,308 | S | * | 11/2000 | Winston | D8/330 |

* cited by examiner

*Primary Examiner*—Stephen K. Cronin
*Assistant Examiner*—James N. Smalley
(74) *Attorney, Agent, or Firm*—Salter & Michaelson

(57) ABSTRACT

A device for securing lids of waste containers is provided. The device may be attached to an existing waste container or, at least part of the device may be formed integrally with the container. The device includes a strap with fasteners at each end that are matingly engageable with each other to secure the lid to the container.

7 Claims, 8 Drawing Sheets

WASTE CONTAINER INCLUDING A DEVICE FOR SECURING A LID THERETO

BACKGROUND

1. Technical Field

The present application is related to a waste container that includes a device for securing a lid in a closed position on the waste container.

2. Related Art

Waste containers, even when they include a lid, are susceptible to having the lid dislodged during inclement weather, by animals seeking food, and during any number of other occurrences. Even lids that fit snugly over the upper end of waste containers may be dislodged by animals seeking food or during inclement weather.

The patent literature is replete with attempts to solve this problem. U.S. Pat. No. 3,980,202 to Monyak et al. discloses a device for maintaining the lid of a waste container on the container. The device of Monyak is a strap having loops at each end for retaining a clamping device at each end. The clamping devices are used to attach the strap to the handle of the cover.

U.S. Pat. No. 4,545,501 to Deford discloses a strap having snaps at each end for forming loops, which can be attached to opposing handles of a waste container.

U.S. Pat. No. 5,297,692 to Kronmiller discloses a strap having a ring attached to one end and a hook and loop type fastener at the opposing end. The strap is secured to one handle of a waste container by sliding the strap around the handle and threading the end with the hook and loop through the ring. The strap is then extended across the cover, threaded under the lid handle, through a second handle opposite the first, and is then folded back upon itself to engage the hook and the fastener.

U.S. Pat. No. 5,738,395 to Probst discloses a waste container for use with an automated garbage truck which includes a weighted closure device.

SUMMARY

In one embodiment, the present disclosure is directed to a waste container that includes a lid connected to the container by a hinge. An engagement member is included on an outer surface of the container opposite the hinge. The waste container also includes a retaining device having first and second opposing ends. A first fastener is attached to the first end of the retaining device and a second fastener is attached to the second end of the retaining device. The first fastener is matingly engageable with the second fastener. A securing mechanism is constructed and arranged to secure the retaining device to the lid. The retaining device is constructed and arranged to maintain the lid in a closed position when the retaining device engages the engagement member and the first and second fasteners are matingly engaged with each other in a first engaged position, and to release the lid from the closed position when the first and second fasteners are in a second non-engaged position.

In one embodiment, the present disclosure is directed to the combination of a waste container that includes a lid connected to the container by a hinge. The waste container includes an engagement member disposed on an outer surface of the container. The lid includes a retaining device having first and second opposing ends, and a first fastener attached to the first end and a second fastener attached to the second end. The first fastener is matingly engageable with the second fastener. The lid also includes a securing mechanism constructed and arranged to secure the retaining device to the lid. The retaining device is constructed and arranged to maintain the lid in a closed position on the waste container when the retaining device is wrapped around the engagement member and the first and second fasteners are matingly engaged with each other, in a first engaged position, and to release the lid from the closed position when the first and second fasteners are in a second, non-engaged position.

In another embodiment, the disclosure is directed to a kit for a waste container that includes a container portion and a lid. The kit includes means for retaining the lid to the container, means for securing the means for retaining the lid to the container, and first and second fastening means attached to the means for retaining. The first means for fastening may be matingly engageable with the second means for fastening. The means for retaining is constructed and arranged to maintain the lid in a closed position when the fastening means are in an engaged position and to release the lid from the closed position when the fastening means are in a non-engaged position.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION OF THE PREFERRED EMBODIMENTS

The present disclosure is directed to a waste container that includes a device for retaining the lid of the waste container in a securely closed position.

Figure 1:
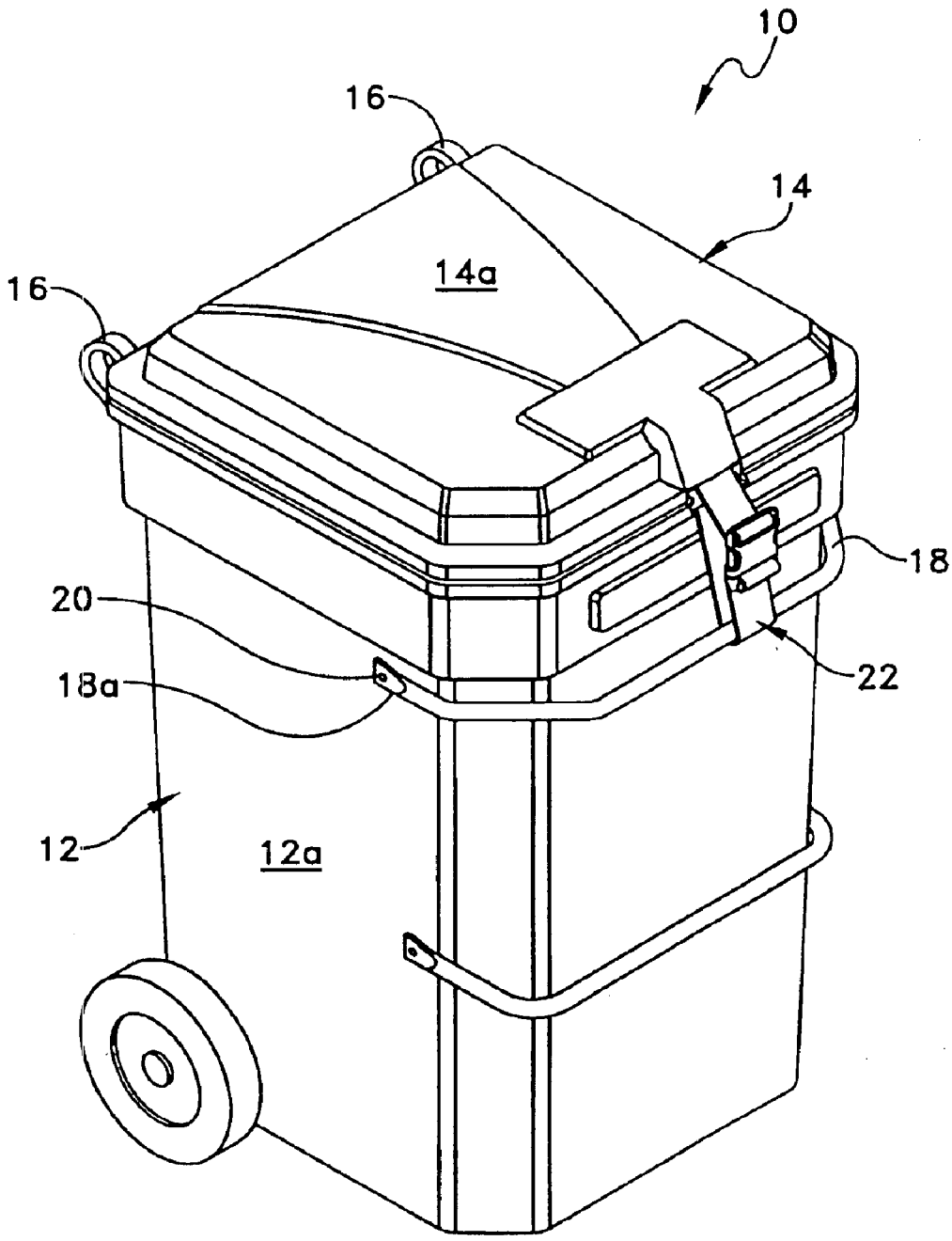
FIG. 1 is a perspective view of one embodiment of a waste container according to the present disclosure, including a retaining device.

One embodiment of a waste container 10 according to the present disclosure is shown in FIG. 1. Waste container 10 includes a container 12 and a lid 14 connected to container 12 by two hinges 16. Waste container 10 is illustrated herein with a substantially square shape, but those of ordinary skill in the art will understand that a square shape is not necessary to the disclosure, and any shape may be used. Hinges 16 may be unitary, as illustrated, or they may be attached or integrally formed with the lid and container. In addition, although illustrated with two hinges, any number of hinges or other means of connecting lid 14 to container 12 may be used.

Opposite from hinges 16 is a device for securing lid 14 to container 12, which is indicated generally at 22, and described in greater detail below.

An engagement member 18 is spaced apart from an exterior surface 12*a* of container 12. Engagement member 18 may be attached, as illustrated, or it may be unitary or integrally formed with the container. When it is attached, as in the present embodiment, engagement member 18 preferably includes opposing ends 18*a,b* through which an attachment to exterior surface 12*a* of container 12 is made by a fastener 20. Fastener 20 is illustrated herein as a rivet, but those of ordinary skill in the art will recognize that any suitable fastener may be used, such as a nut and bolt.

Figure 2:
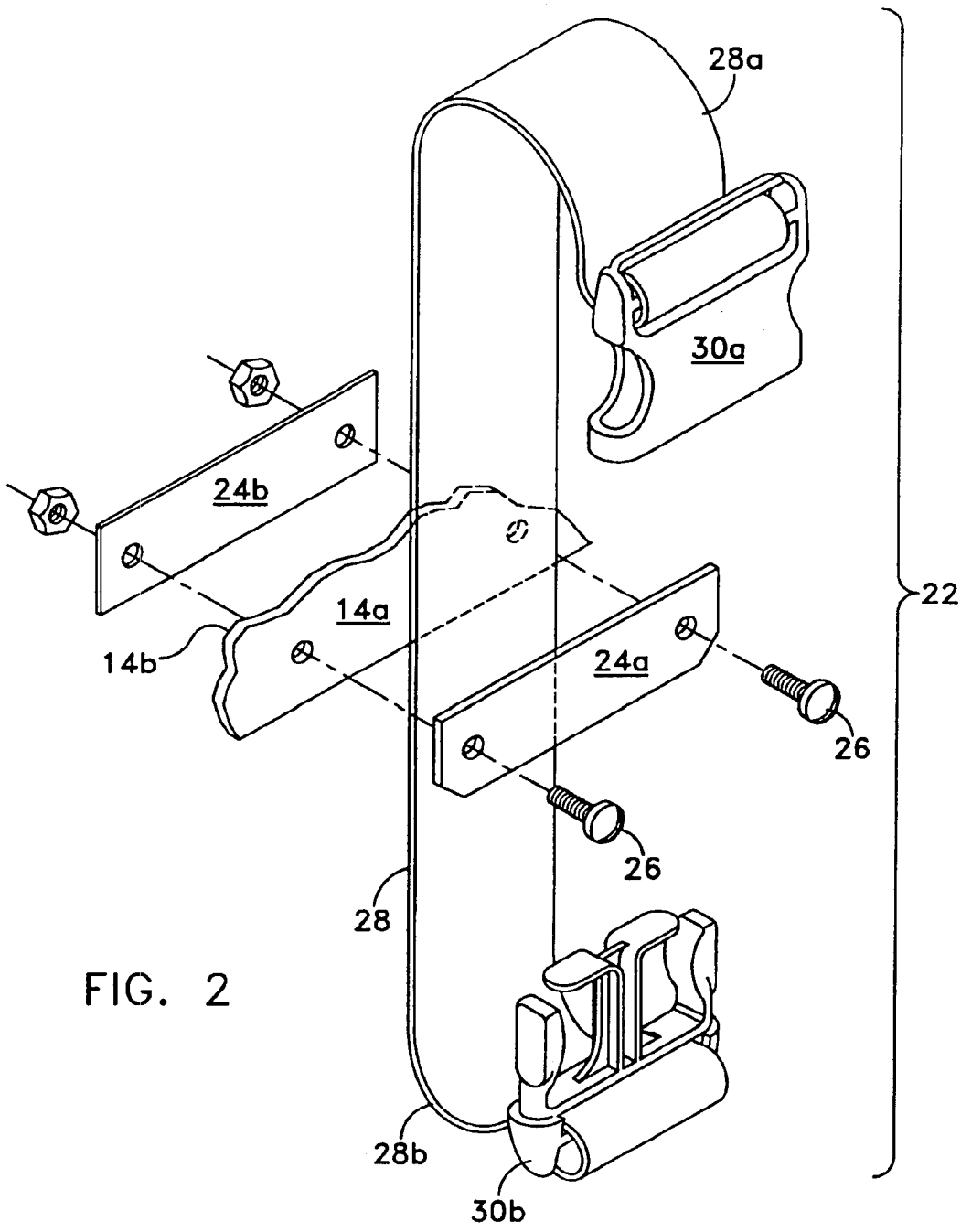
FIG. 2 is an exploded view of the retaining device shown in FIG. 1.
Figure 3:
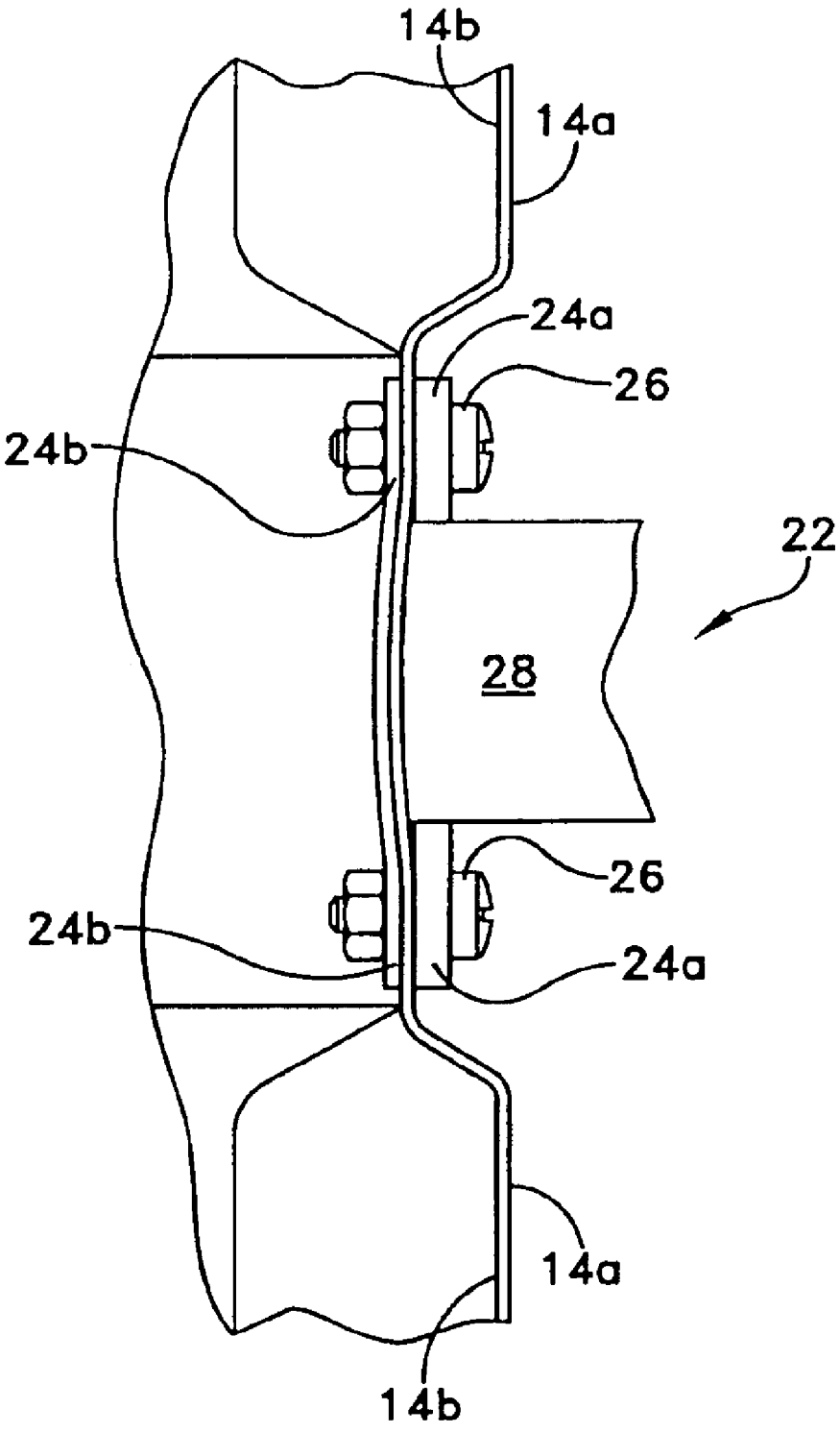
FIG. 3 is an expanded top view of the retaining device of FIG. 1.
Figure 4:
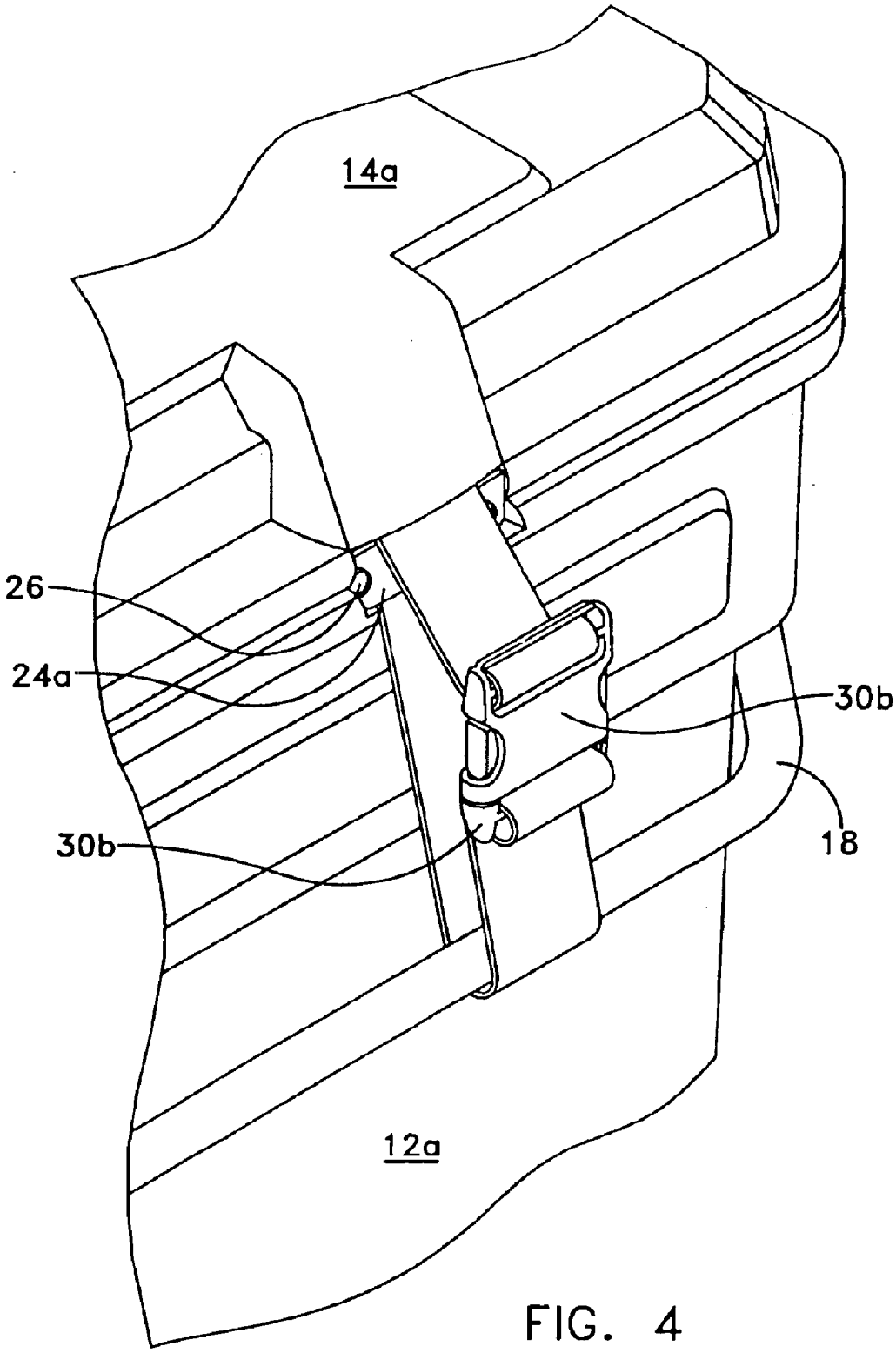
FIG. 4 is an enlarged perspective view of a portion of the waste container of FIG. 1 showing the retaining device in greater detail.

Device 22 is illustrated in greater detail in FIGS. 2–4, when taken together. As shown, device 22 includes a securing mechanism indicated generally at 24, which includes a first securing device 24*a* attached to an exterior surface 14*a* of lid 14. In preferred embodiments, device 22 also includes a second securing device 24*b* attached to an interior surface 14*b* of lid 14. The attachment of first and second securing devices 24*a,b* may be by any appropriate fastener 26 such as rivets, bolts, screws, and the like.

A retaining device 28, which in the present embodiment is a strap, is positioned between first securing device 24*a* and exterior surface 14*a* of lid 14. For ease of illustration, retaining device 28 will be referred to hereinafter as strap 28. Preferably, first securing device 24*a* is spaced apart from exterior surface 14*a* sufficiently to allow strap 28 to slide between first securing device 24*a* and exterior surface 14*a*. However, it is not necessary that strap 28 must slide, and it may be fixed securely between first and second securing devices 24*a,b* provided that a user may still access the fasteners of retaining device 28, which are discussed below.

Retaining device 28 includes fasteners 30*a,b* attached to each opposing end 28*a,b*. Fasteners 30*a,b* may be any type of quick release fastener, such as the type shown in FIG. 2. Fasteners 30*a,b* may be adjustable so as to allow the retaining device to be adapted to different containers having a varying distance between the engagement member. Fastener 30*a* is matingly engageable with fastener 30*b*. Fasteners 30*a,b* are each sized to have a thickness greater than any space between first securing device 24*a* and exterior surface 14*a* of lid 14. In this manner, retaining device 28 is retained in position behind first retaining plate 24*a* and is prevented from sliding completely out of the space between the securing device and the exterior of the lid. In the present embodiment, fasteners 30*a,b* are quick-release type fasteners, which have been found to be user-friendly for humans, but not for animals attempting to access the interior of the container. Such quick-release type fasteners also have been found able to withstand extreme weather conditions without releasing. Although illustrated herein with one device 18, those of skill in the art will recognize that it is possible to include two separate retaining devices 28 to provide a more secure or fallback situation, should one become damaged.

Figure 5:
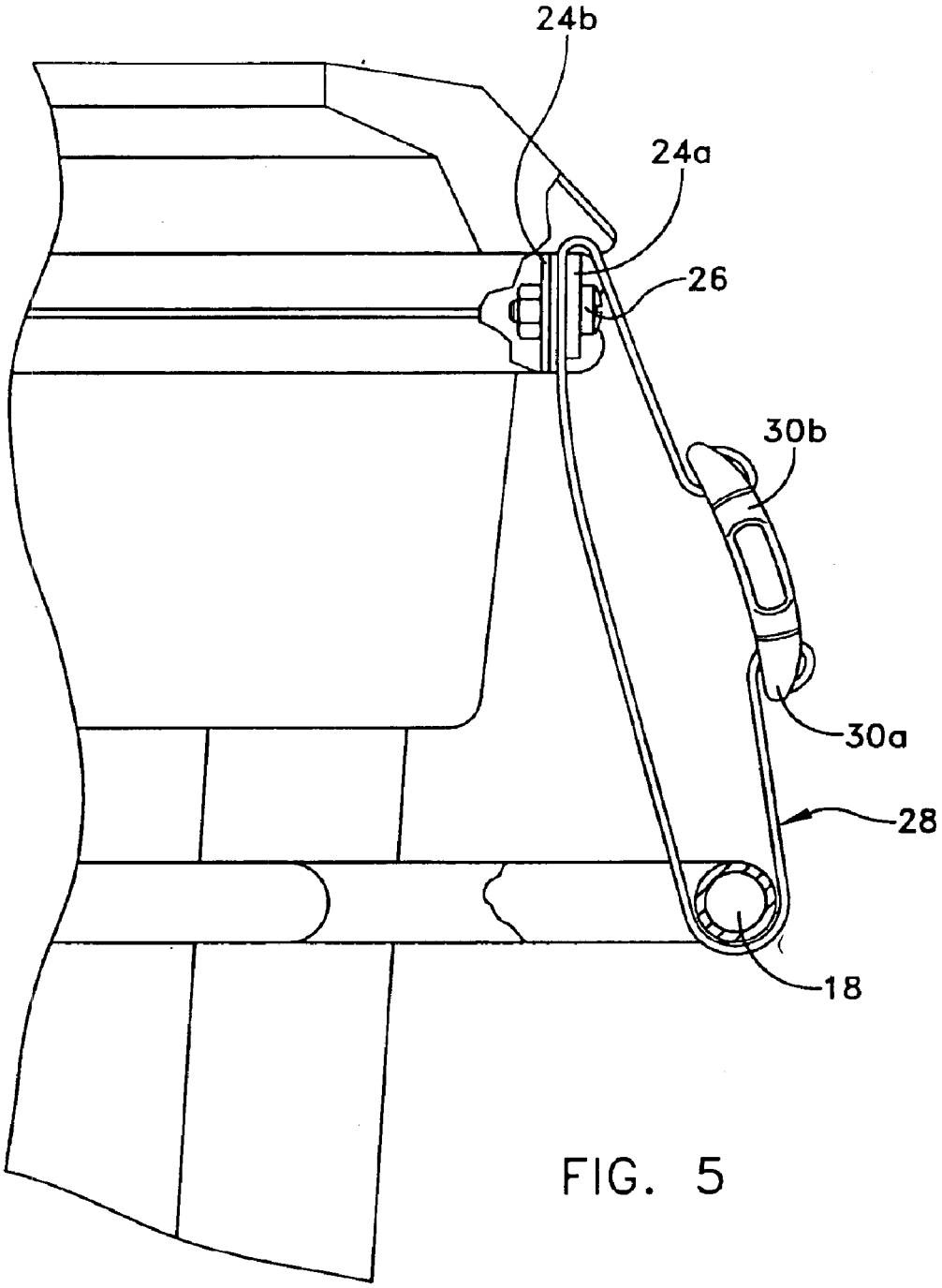
FIG. 5 is an expanded side view of a portion of the waste container of FIG. 1 showing the securing mechanism in an engaged position.

In use, as shown in FIG. 5, to secure lid 14 to container 12, a user simply wraps strap 28 around engagement member 18 and engages fastener 30*a* with fastener 30*b*. Thus, strap 28, which is attached to lid 14, is secured about engagement member 18, which is attached to container 12. In this manner, lid 14 is quickly and easily secured to container 12.

Figure 6:
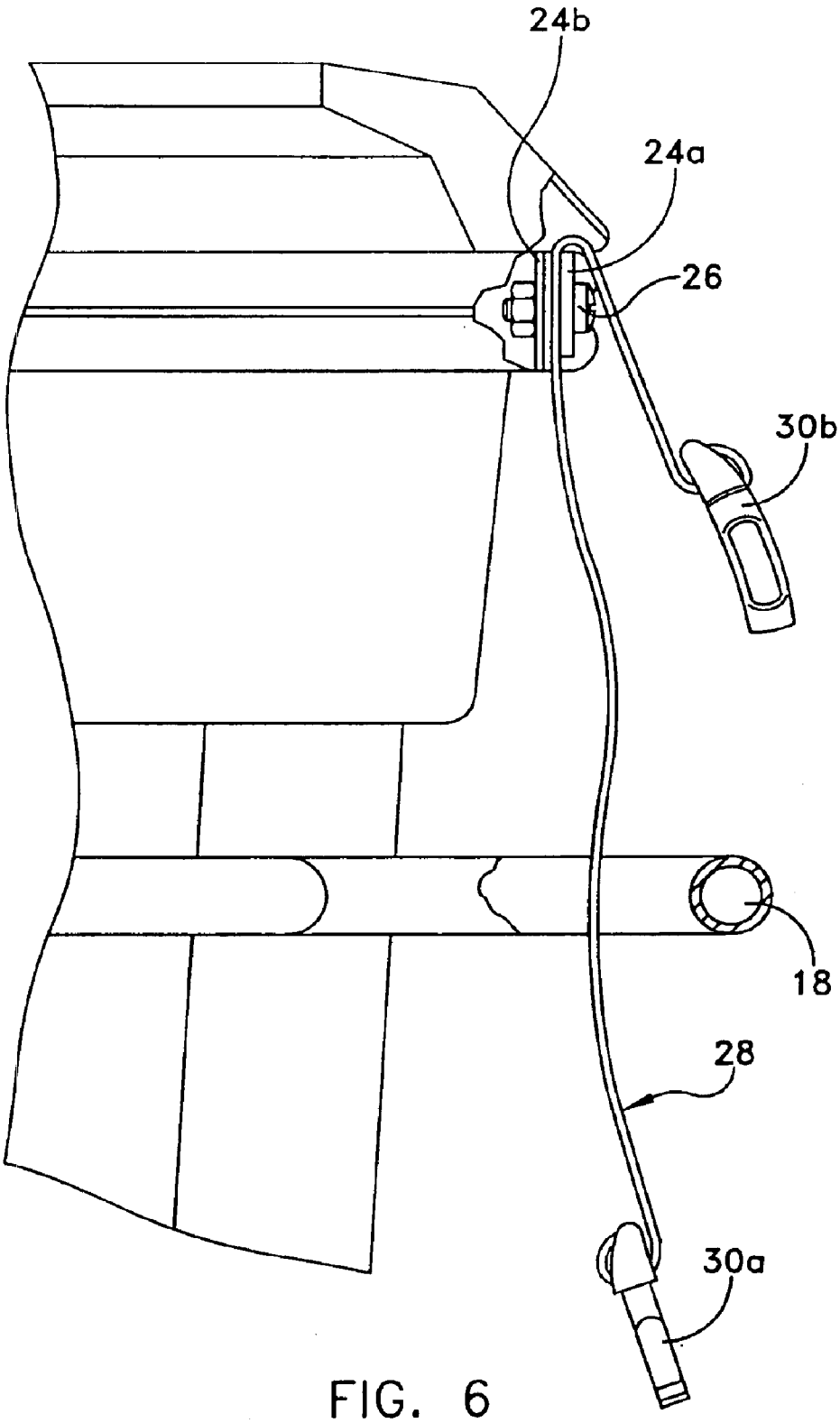
FIG. 6 is an expanded side view of a portion of the waste container of FIG. 1 showing the securing mechanism in a disengaged position.

To open lid 14, as shown in FIG. 6, a user simply disengages fastener 30*a* from fastener 30*b*, allowing each end of strap 28 to drop down under the force of gravity. Lid 14 may then be lifted upwardly without interference from device 22, as end 28*b* will simply be lifted upwardly behind engagement member 18. In this manner, additional refuse may be added to the container or the container may be manually inverted in order to dispose of refuse contained therein.

Waste container 10 also may be inverted using an automated garbage truck. To do so, the operator of the automated garbage truck must simply release device 22; the device will be retained with the lid during discharge of the contents into the truck.

Figure 7:
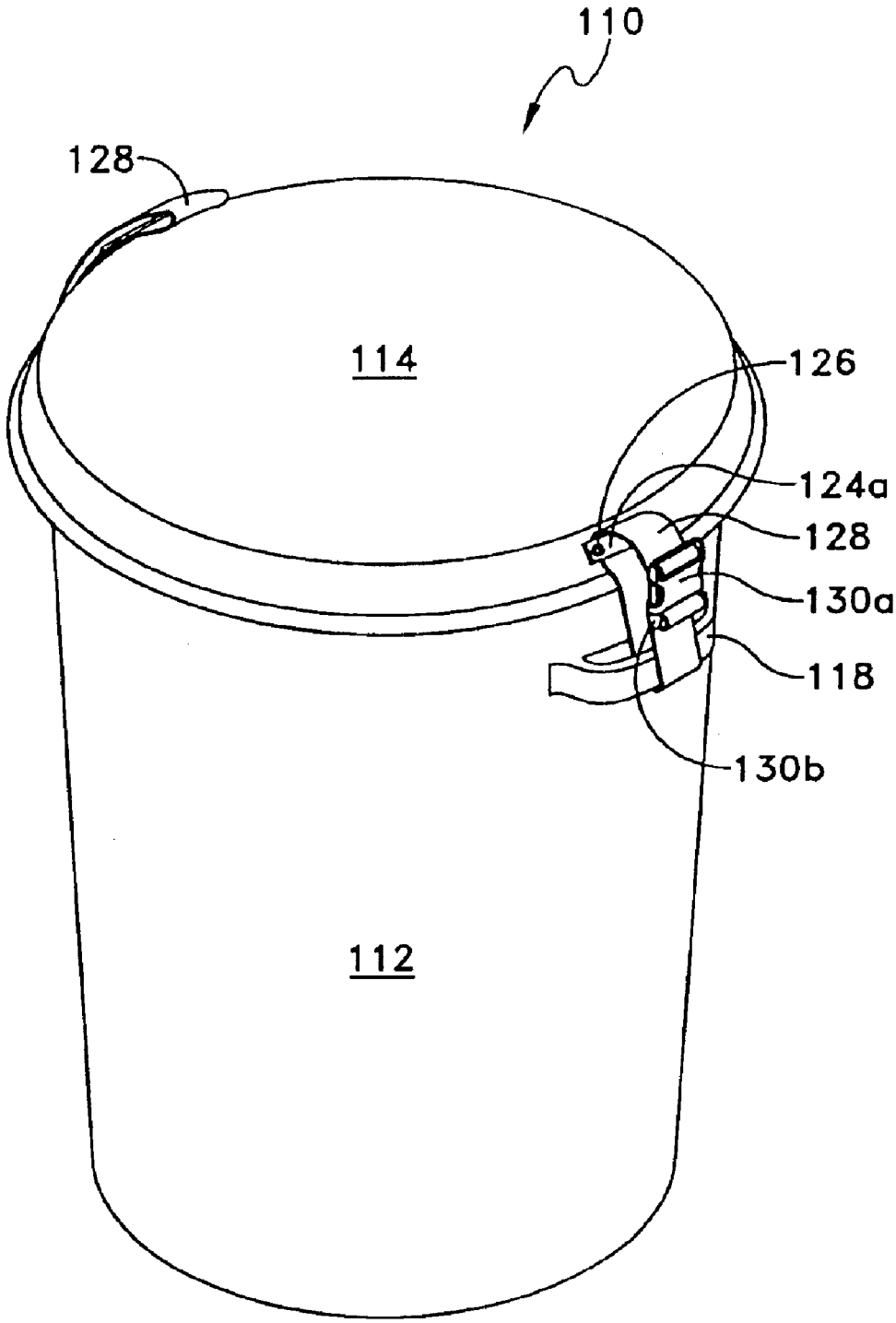
FIG. 7 is a perspective view of another embodiment of a waste container according to the present disclosure including two retaining devices.
Figure 8:
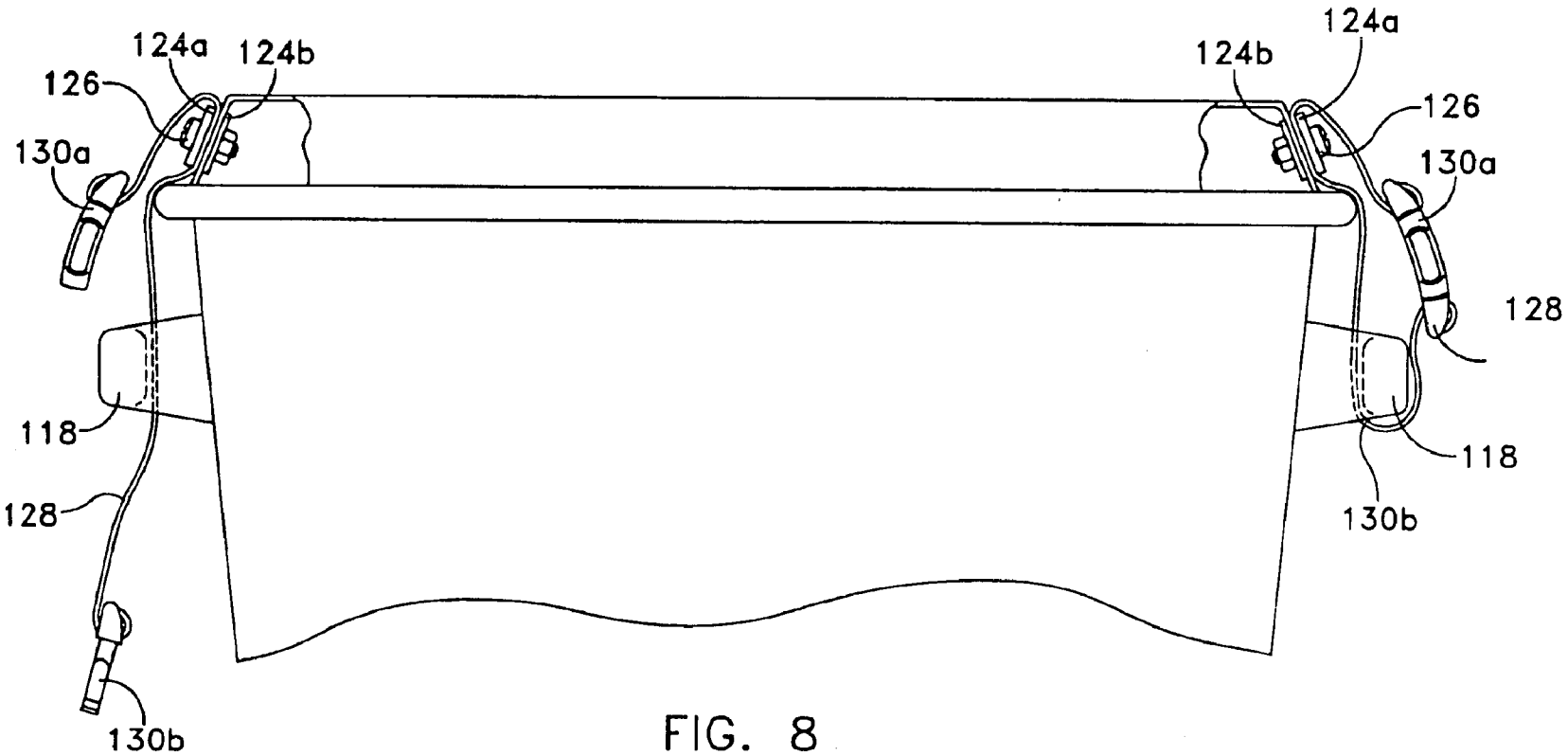
FIG. 8 is a side view of the waste container of FIG. 7.

Device 22 may be attached to a variety of waste containers by retrofitting the existing waste container with the device. One example of this is shown in FIGS. 7–8 taken together, in which the same reference number have been used as the previous embodiment, preceded by the number "1." As shown in the present embodiment, waste container 110 includes a container 112 and a detached lid 114. Two engagement members 118 are spaced apart from an exterior surface 112*a* of container 112. In the present embodiment, engagement members 118 are handles that are unitary or integrally formed with the container 112. Two devices 122 are attached at opposite points of the periphery of lid 114 as discussed above with respect to the previous embodiment.

In use, lid 114 is secured to container 112, by wrapping each strap 128 around a single engagement member 118, and each fastener 130*a* is matingly engaged with fastener 130*b*. Thus, straps 128, which are attached to lid 114, are secured about engagement members 118, which are attached to container 112. In this manner, lid 114 is quickly and easily secured in a closed position on container 112.

To open lid 114, a user simply disengages at least one fastener 130*a* from at least one corresponding fastener 130*b*, allowing the disengaged strap ends 128*a,b* to drop down under the force of gravity. Lid 114 may then be lifted upwardly without interference from straps 128, as ends 128*b* simply will be lifted upwardly behind and through engagement member(s) 118. In this manner, additional refuse may be added to the container or the container may be manually inverted in order to dispose of the refuse contained therein. A user may choose to leave one device 128 attached when so doing to ensure that the lid always remains with the container.

Preferably, straps 28,128 are formed from any type of high strength webbing. Those of skill in the art will recognize that the webbing may be replaced periodically if and when necessary by removing the retaining device.

In the present embodiment, engagement member 18 is illustrated as a bar of the type typically used on trash containers that are compatible with automatic trash trucks. Those of ordinary skill in the art will recognize that the disclosure is not limited to such a bar, and that any type of engagement member may be used provided it can be attached to the container or lid, and provided a strap may be slidably engaged in the engagement member. For example, it is possible to include a retaining device 22 of the type discussed above, on an exterior surface of a trash container, by which strap 28 may be slidably attached to the container. Alternatively or in addition, it is possible to include a retaining device 22 of the type discussed above, on a lid of a trash container, by which strap 28 may be slidably attached to the container. In this manner, it is possible for a homeowner to retro-fit a trash containers by retrofitting it with one or more of the devices 22.

Accordingly, another embodiment of the present disclosure is a kit for retro-fitting a trash container. A kit according to the present embodiment would include at least one of the foregoing devices 22 for attachment to a container, and at least one retaining device 28. If desired, such a kit may also include tools for attaching the devices 22 to the container and/or lid of the trash container, as well as instructions for so doing.

Although particular embodiments of the disclosure have been described in detail for purposes of illustration, various changes and modifications may be made without departing from the scope and spirit of the disclosure. Accordingly, the disclosure is not to be limited except as by the appended claims. For example, the apparatus and method of the disclosure may be applied to processes that are presently not practically feasible.

What is claimed is:

1. A waste container, comprising:

a container body;

a lid connected to the container body by a hinge;

a horizontally disposed engagement member on an outer surface of the container body opposite the hinge;

a retaining device comprising a retaining strap having first and second opposing ends and adapted to extend in a vertical direction between the engagement member and lid;

a first fastener attached to the first end of the retaining device and a second fastener attached to the second end of the retaining device, the first fastener being matingly engageable with the second fastener; and a first securing mechanism constructed and arranged to secure the retaining strap to the lid such that the retaining strap is slidable between an exterior of the lid and the first securing mechanism;

wherein the retaining device is constructed and arranged to maintain the lid in a closed position when the retaining strap is engaged with the engagement member and the first and second fasteners are matingly engaged with each other in a first engaged position, and to release the lid from the closed position when the first and second fasteners are in a second non-engaged position;

wherein the securing mechanism includes a first securing device attached to an exterior surface of the lid and defining a space therebetween so as to enable the strap to slide therethrough;

wherein the thickness of at least one of said first and second fasteners is greater than the space between the first securing mechanism and the exterior of the lid so as to prevent the retaining strap from sliding completely out of said space.

2. The waste container of claim 1, wherein the securing mechanism includes a second securing device attached to an interior surface of the lid.

3. The waste container of claim 1, wherein the securing mechanism and the lid are unitary.

4. The waste container of claim 1, wherein the retaining device and the container are unitary.

5. The waste container of claim 1, wherein the retaining device is a nylon web.

6. The waste container of claim 1, wherein the first and second fasteners are quick-release fasteners.

7. The combination of claim 1, wherein the engagement member is a second securing mechanism constructed and arranged to secure the retaining device to the container.

* * * * *